US008726973B2

(12) United States Patent
Hewitt

(10) Patent No.: US 8,726,973 B2
(45) Date of Patent: May 20, 2014

(54) METHOD OF PRODUCING AN INTEGRAL SELF SUPPORTING COATING TEST PIECE FROM A COATING MATERIAL

(75) Inventor: Andrew Hewitt, Derby (GB)

(73) Assignee: Rolls-Royce PLC, London (GB)

( * ) Notice: Subject to any disclaimer, the term of this patent is extended or adjusted under 35 U.S.C. 154(b) by 212 days.

(21) Appl. No.: 13/008,509

(22) Filed: Jan. 18, 2011

(65) Prior Publication Data

US 2011/0183077 A1 Jul. 28, 2011

(30) Foreign Application Priority Data

Jan. 26, 2010 (GB) ..... 1001179.9

(51) Int. Cl.
*B22C 9/00* (2006.01)
*B22D 23/00* (2006.01)

(52) U.S. Cl.
USPC ..... 164/6; 164/19; 164/46

(58) Field of Classification Search
USPC ..... 164/6, 19, 46
See application file for complete search history.

(56) References Cited

U.S. PATENT DOCUMENTS 3,112,539 A 12/1963 Barker
3,533,873 A * 10/1970 Wilson ..... 156/249
3,547,720 A 12/1970 Jones
4,726,412 A 2/1988 Magnan et al.
5,763,107 A 6/1998 Rickerby et al.
2005/0263923 A1* 12/2005 Hopkins et al. ..... 264/81

FOREIGN PATENT DOCUMENTS

| | | | |
|---|---|---|---|
| CA | 2126538 | A1 | 12/1995 |
| DE | 2 118 071 | A1 | 11/1972 |
| DE | 2 133 010 | A1 | 1/1973 |
| EP | 1 600 522 | A2 | 11/2005 |
| EP | 1 995 343 | A2 | 11/2008 |
| GB | 2 338 666 | A | 12/1999 |
| JP | A-2008-174787 | | 7/2008 |
| WO | WO 2005/038074 | A1 | 4/2005 |

OTHER PUBLICATIONS

British Search Report issued in British Patent Application No. 1001179.9 dated May 12, 2010.
Search Report issued in corresponding European Application No. EP 11 15 1287 dated Mar. 3, 2011.

* cited by examiner

*Primary Examiner* — Kevin P Kerns
(74) *Attorney, Agent, or Firm* — Oliff PLC

(57) ABSTRACT

A method of producing an integral self supporting coating test piece from particulate material including the steps of (i) producing a reusable mould having a depression which conforms to the desired shape and volume of said coating test piece, the reusable mould including silicone rubber, (ii) roughening the surface of the reusable mould, (iii) heat treating the reusable mould, (iv) thermally spraying particulate material into the depression in the reusable, mould, and (v) removing the reusable mould from the solidified coating test piece.

15 Claims, 1 Drawing Sheet

METHOD OF PRODUCING AN INTEGRAL SELF SUPPORTING COATING TEST PIECE FROM A COATING MATERIAL

BACKGROUND

The present invention relates to a method of producing an integral self supporting coating test piece from a coating material.

Coating materials are used to cover the surfaces of metallic articles, or components, so as to protect the metallic articles from degradation when subjected to hostile working conditions. An example of such a metallic article is a turbine blade, or a turbine vane, which operates in a gas turbine engine.

It is known to make turbine blades, or turbine vanes, from a given material and then coat the aerofoil portions of the turbine blades, or turbine vanes, with another material more able to withstand the high temperature gases that flow over the surfaces of the aerofoil portions of the turbine blades, or turbine vanes. The coating may be a metal alloy layer, a ceramic layer, a mixture of metal and ceramic layer or a combination of a metal layer and a ceramic layer. The coating is normally applied by the known techniques of thermal spraying and plasma spraying and the coating is very thin. It is important to have some idea of the structural integrity of the coating itself, and the quality of its adhesion to the aerofoil portions of the turbine blades, or turbine vanes, prior to actual use of the coating on the turbine blades or turbine vanes.

There are a number of difficulties when trying to obtain data from coatings. Firstly coatings are generally too thin to gain useful results when the coating is attached to an article. Secondly the article is often stronger and/or stiffer than the coating and the effects of the article contaminate the test results. Thirdly the coating produced by thermal spraying, or plasma spraying, has a particulate structure with different properties to cast materials of the same composition, thus it is not possible to look up material data from a data book of predetermined compositions. Fourthly the coating itself may be a composite material with complex properties, e.g. the coating is a mixture of metal and ceramic.

When making a coating test piece, it is known to provide a salt based flat slab and to thermally spray a particulate coating material on to one surface of the salt slab. During the thermal spraying, or plasma spraying, of particulate material, on contact with a surface of an article the molten particles cool rapidly and contract. Molten particles following and contacting the semi-cooled particles generate residual stresses in the coating material. If as sometimes happens, the bond between the coating and the salt slab is not sufficiently strong, the coating delaminates. Further if the salt slab is not sufficiently stiff, again as sometimes happens, the aforementioned residual stresses may induce distortion into the coating material and the salt slab. The resulting poor quality coating, when removed from the salt slab has too frequently proved unable to maintain an integral self supporting form that would give sufficiently accurate indication of strength when stressed on a standard mechanical test machine.

It is also known, from our published European patent application EP1600522A2, to provide an integral self supporting coating test piece from particulate material by providing a dissolvable mould, made from a dissolvable plastic, thermally spraying particulate material onto the dissolvable mould and then dissolving the dissolvable mould away from the coating test piece. However, there is a problem with this method of producing a coating test piece in that a new dissolvable mould has to be made for each coating test piece produced. The dissolvable moulds provide limited mechanical stability, which may lead to high scrap rates.

SUMMARY

Accordingly the present invention seeks to provide a novel method of producing an integral self supporting test coating piece from particulate material which reduces, preferably overcomes, the above mentioned problems.

Accordingly the present invention provides a method of producing an integral self supporting coating test piece from particulate material comprising the steps of (i) producing a reusable mould having a depression which conforms to the desired shape and volume of said coating test piece, the reusable mould comprising a resilient polymeric material, (ii) roughening the surface of the reusable mould, (iii) heat treating the reusable mould, (iv) thermally spraying particulate material into the depression in the reusable mould, and (v) removing the reusable mould from the solidified coating test piece.

Preferably step (iv) comprises plasma spraying, flame spraying, combustion spraying or HVOF spraying.

Preferably the particulate material comprises a metal, an alloy, a ceramic or a mixture of metal and ceramic.

Preferably step (ii) comprises grit blasting the reusable mould.

Preferably step (iii) comprises heating the reusable mould to a temperature of 100° C. to 200° C.

Preferably step (iii) comprises heating the reusable mould using the thermal spray gun.

Preferably the coating test piece comprises a thermal barrier coating, an environmental protective coating, a wear resistant coating or an abradable coating.

Preferably step (v) comprises removing the reusable mould from the integral self supporting coating test piece by deforming the reusable mould.

Preferably step (v) comprises by peeling, stretching, bending, flexing and/or stretching the reusable mould.

Preferably there is a subsequent step of machining the integral self supporting coating test piece after step (v).

There may be a step of machining the integral self supporting coating test piece after step (iv) and before step (v).

Preferably there is a subsequent step of mechanically testing the integral self supporting coating test piece to determine the mechanical properties of the coating material.

Preferably the mechanical testing comprises tensile testing, fatigue testing, creep testing or CT testing.

BRIEF DESCRIPTION OF THE DRAWINGS

The present invention will be more fully described with reference to the accompanying drawings, in which.

BRIEF DESCRIPTION OF THE EMBODIMENTS

Figure 1:
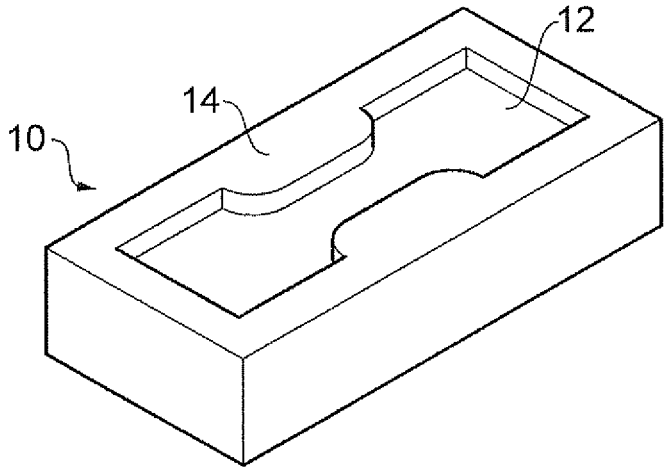
FIG. 1 is a perspective view of a mould used in a method of producing an integral self supporting coating test piece from particulate material according to the present invention.
Figure 2:
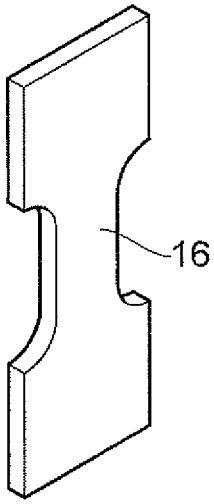
FIG. 2 is a perspective view of an integral self supporting coating test piece formed in the mould of FIG. 1.

A reusable mould 10 has a depression 12 of a desired shape and depth formed in a surface 14. An integral self supporting coating test piece 16, as shown in FIG. 2, is produced in the reusable mould 10. The reusable mould 10 comprises a resilient, elastic, polymeric material, i.e. an elastomer. In this example the resilient elastic, polymeric material comprises silicone rubber. The surface of the reusable mould 10 is grit blasted to roughen the surface of the reusable mould 10 to assist the adherence of the particulate coating material deposited into the depression 12 in the surface 14 of the reusable mould 10. The surface of the reusable mould 10 may also have a pattern to aid the adherence of the particulate coating material deposited into the depression 12 in the surface of the reusable mould 10. The pattern may comprise a series of parallel grooves or two sets of grooves and a first set of grooves is arranged perpendicular to a second set of grooves etc. The reusable mould 10 is then heat treated at a temperature of 100° C. to 200° C. to remove surface contamination, grease, plasticisers, moisture etc from the surface of the reusable mould 10, to preheat the reusable mould 10 and cause the reusable mould 10 to expand. Preferably the reusable mould 10 is heated using the thermal spray gun without the supply of material to the thermal spray gun. Then material is supplied to the thermal spray gun and molten particles of a particulate coating material are thermally sprayed into the depression 12 in the surface 14 of the reusable mould 10 to the required depth. The thermal spraying may be such as to overfill the depression 12. After the particulate coating material has solidified the reusable mould is then removed from the solidified particulate coating material leaving an integral self supporting coating test piece 16. The integral self supporting coating test piece is then machined to final shape and to provide a suitable surface finish on the integral self supporting coating test piece 16.

The particulate coating material tends to bounce off the reusable mould 10, because it is resilient, but the provision of the rough surface or the provision of the rough surface and the pattern on the surface aids the adherence of the particulate coating material in the depression 12 in the reusable mould 10.

The reusable mould 10 is removed from the integral self supporting coating test piece by deforming the reusable mould 10, e.g. by peeling, stretching, bending, flexing and/or stretching the reusable mould 10.

Figure 3:
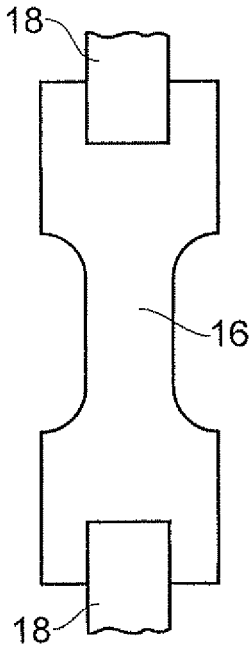
FIG. 3 is a view of the integral self supporting coating test piece of FIG. 2 in situ in a mechanical test rig.

The method of producing an integral self supporting coating test piece may be used to produce a number of integral self supporting coating test pieces with different dimensions and/or different shapes for mechanically testing, for example tensile testing, fatigue testing, creep testing or CT testing to obtain data, e.g. to measure the tensile, fatigue, creep, compression and CT properties and performance characteristics of the coating material. The mechanical testing may be used to determine Young's Modulus at one or more temperatures for each coating material, integral self supporting coating test piece. FIG. 3 shows an integral self supporting coating test piece 16 in the jaws 18 of a mechanical test rig.

The advantage of the present invention is that the resilient, elastic, polymeric material reusable mould allows for the generation of reliable and reproducible integral self supporting coating test pieces, which allow previously undetermined, or poorly qualified, coating material properties to be measured, e.g. tensile strength, Young's Modulus, fatigue properties, sintering, thermal degradation. Another advantage of the resilient, elastic, polymeric material reusable mould is that each reusable mould may be used a plurality of times to produce a plurality of integral self supporting coating test pieces and thus reduces the cost of producing the integral self supporting coating test pieces. The resilient, elastic, polymeric material reusable mould is easier to handle, e.g. it is less likely to be damaged during the production of the integral self supporting coating test piece.

The present invention is applicable to the production of integral self supporting coating test pieces by any thermal spraying technique, for example plasma spraying, flame spraying, combustion spraying, HVOF spraying etc. The present invention is applicable to various coatings for example thermal barrier coatings, e.g. zirconia or yttria stabilised zirconia, or other ceramics, metal bond coatings and environmental protective coatings, e.g. metals, alloys MCrAlY, MCrAl, wear or erosion resistant coatings, e.g. WC/Co. The present invention is also applicable to compliant coatings, abradable coatings, e.g. AlSi plus dislocators and composite coatings e.g. MCrAlY plus hBN plus polyester.

Although the present invention has been described as machining the integral self supporting coating test piece after it has been removed from the reusable mould, it may be possible to perform some machining of the integral self supporting coating test piece before it is removed from the reusable mould.

Although the present invention has been described with reference to a silicone rubber reusable mould it may be possible to use other resilient, elastic, polymeric materials to form the reusable mould if the other resilient, elastic, polymeric materials are capable of withstanding the temperatures of 100° C. to 200° C. used to preheat the reusable mould and capable of withstanding temperatures, which may be greater than 200° C., used in the deposition of the particulate material. The resilient, elastic, polymeric material is preferably an elastomer, i.e. it has the properties of natural rubber.

It may be possible to preheat the reusable mould using other techniques, for example by placing in an oven. It may be possible to roughen the surface of the reusable mould using other suitable techniques.

The invention claimed is:

1. A method of producing an integral self-supporting solidified coating test piece from particulate material comprising the steps of (i) producing a reusable mold having a depression which conforms to a desired shape and volume of said coating test piece, the reusable mold consisting of a resilient polymeric material, (ii) roughening a surface of the reusable resilient polymeric material mold, (iii) heat treating the reusable resilient polymeric material mold, (iv) thermally spraying particulate material into the depression in the reusable resilient polymeric material mold, and (v) removing the reusable resilient polymeric material mold from the solidified coating test piece.

2. A method as claimed in claim 1 wherein step (iv) is selected from the group consisting of plasma spraying, flame spraying, combustion spraying and HVOF spraying.

3. A method as claimed in claim 1 wherein the particulate material is selected from the group consisting of a metal, an alloy, a ceramic and a mixture of metal and ceramic.

4. A method as claimed in claim 1 wherein step (ii) comprises grit blasting the reusable resilient polymeric material mold.

5. A method as claimed in claim 1 wherein step (iii) comprises heating the reusable resilient polymeric material mold to a temperature of 100° C. to 200° C.

6. A method as claimed in claim 1 wherein step (iii) comprises heating the reusable resilient polymeric material mold using a thermal spray gun.

7. A method as claimed in claim 1 wherein the coating test piece is selected from the group consisting of a thermal barrier coating, an environmental protective coating, a wear resistant coating and an abradable coating.

8. A method as claimed in claim 1 wherein step (v) comprises removing the reusable resilient polymeric material mold from the integral self-supporting coating test piece by deforming the reusable resilient polymeric material mold.

9. A method as claimed in claim 8 wherein step (v) is selected from the group consisting of peeling, stretching, bending, flexing and stretching the reusable resilient polymeric material mold.

10. A method as claimed in claim 1 wherein there is a subsequent step of machining the integral self-supporting coating test piece after step (v).

11. A method as claimed in claim 1 wherein there is a step of machining the integral self-supporting coating test piece after step (iv) and before step (v).

12. A method as claimed in claim 1 wherein there is a subsequent step of mechanically testing the integral self-supporting coating test piece to determine the mechanical properties of the coating material.

13. A method as claimed in claim 12 wherein the mechanical testing is selected from the group consisting of tensile testing, fatigue testing, creep testing and CT testing.

14. A method as claimed in claim 1 wherein the resilient polymeric material comprises silicone rubber.

15. A method of producing an integral self-supporting coating test piece from particulate material comprising the steps of:

(i) producing a reusable mold having a depression which conforms to the desired shape and volume of said coating test piece, the reusable mold consisting of a resilient polymeric material;

(ii) roughening the surface of the reusable resilient polymeric material mold;

(iii) heat treating the reusable resilient polymeric material mold;

(iv) thermally spraying particulate material into the depression in the reusable resilient polymeric material mold;

and (v) removing the reusable resilient polymeric material mold from the solidified coating test piece, wherein the reusable resilient polymeric material mold is removed from the solidified coating test piece from a method selected from the group consisting of deforming, peeling, stretching, bending, flexing and stretching the reusable resilient polymeric material mold.

* * * * *